US007065817B2

(12) United States Patent
Shield

(10) Patent No.: US 7,065,817 B2
(45) Date of Patent: Jun. 27, 2006

(54) BODY BED

(76) Inventor: Vickie L. Shield, 157 Sierra Dr., Apt. 6, Walnut Creek, CA (US) 94596

( * ) Notice: Subject to any disclaimer, the term of this patent is extended or adjusted under 35 U.S.C. 154(b) by 0 days.

(21) Appl. No.: 10/935,059

(22) Filed: Sep. 7, 2004

(65) Prior Publication Data

US 2005/0050641 A1 Mar. 10, 2005

Related U.S. Application Data

(60) Provisional application No. 60/501,521, filed on Sep. 9, 2003.

(51) Int. Cl.
*A47G 9/00* (2006.01)

(52) U.S. Cl. ..... 5/735; 5/930

(58) Field of Classification Search ..... 5/735, 5/930; 280/801.1; D6/361; 297/283.1, 297/284.1

See application file for complete search history.

(56) References Cited

U.S. PATENT DOCUMENTS

| | | | | |
|---|---|---|---|---|
| 2,089,854 | A * | 8/1937 | Pellegrini | 5/735 |
| 3,967,335 | A * | 7/1976 | Rhoads | 5/632 |
| 4,508,384 | A * | 4/1985 | Castelot et al. | 297/284.1 |
| D355,983 | S * | 3/1995 | Mutch | D6/361 |
| 5,438,715 | A * | 8/1995 | Jackman | 5/110 |

* cited by examiner

*Primary Examiner*—Jong-Suk (James) Lee
*Assistant Examiner*—Fredrick Conley
(74) *Attorney, Agent, or Firm*—Bruce H. Johnsonbaugh

(57) ABSTRACT

A body bed is provided for use by pregnant women and other persons for sleeping on their stomachs. A mattress includes a tummy well formed in the central region thereof and a tummy well strap including VELCRO attached to both ends of the strap. The bottom surface of the mattress has VELCRO material so that the tummy well strap may be continuously adjusted to any length to provide optimum support for the spine of the user. The mattress may also include a separate breast well and a separate breast well strap having VELCRO ends which may be continuously adjusted to any length to provide optimum support for the spine of the user.

3 Claims, 7 Drawing Sheets

BODY BED

CROSS-REFERENCE TO RELATED APPLICATION

This application claims the benefit of and priority from U.S. provisional application Ser. No. 60/501,521 filed Sep. 9, 2003.

BACKGROUND AND BRIEF SUMMARY OF INVENTION

The present invention pertains to a bed which allows pregnant women to sleep on their stomachs during their pregnancy. More particularly, the present invention provides adjustable support for the stomach and breasts to reduce pressure on the spine as the pregnancy progresses. The invention is also usable by men and women that have had abdominal surgery and need to sleep on their stomachs. It is also usable for patients who have undergone other types of surgery such as breast surgery or back surgery wherein sleeping on the stomach is desirable.

It is known in the prior art to provide mattress designs having tummy wells and breast wells which allow pregnant women to sleep on their stomachs. Most of those prior art designs utilize inserts which provide only a small number of adjustments to the size of the tummy well and the breast well. There is a need for a body bed which allows an adjustable support for the tummy well and breast well wherein the adjustment is continuously variable as opposed to being adjustable through a small number of discrete steps.

The present invention provides for this continuous adjustability by utilizing support cloths which extend over the tummy well and breast well which have VELCRO on both ends. The ends of those cloths are attached under the body bed. The VELCRO fastening allows the straps to be adjusted to any desired degree deemed suitable for the user.

A primary object of the invention is to provide a bed on which pregnant women and others may sleep on their stomachs, and which provides tummy and breast wells along with continuously adjustable tummy well and breast well straps to provide optimum support for the user's spine.

A further object is to provide a bed on which pregnant women and others may sleep on their stomachs having continuously adjustable straps with VELCRO fasteners.

Other objects and advantages will become apparent from the following description and drawings, wherein:

DETAILED DESCRIPTION OF THE DRAWINGS

FIGS. 1–4 show a body bed mattress 10 constructed of foam or other suitable bedding material. Mattress 10 has a tummy well 20 formed in the central region of mattress 10. Tummy well 20 extends through the entire thickness of mattress 10. A separate breast well 30 is formed in mattress 10 and extends approximately half way through the thickness of mattress 10.

Figure 7:
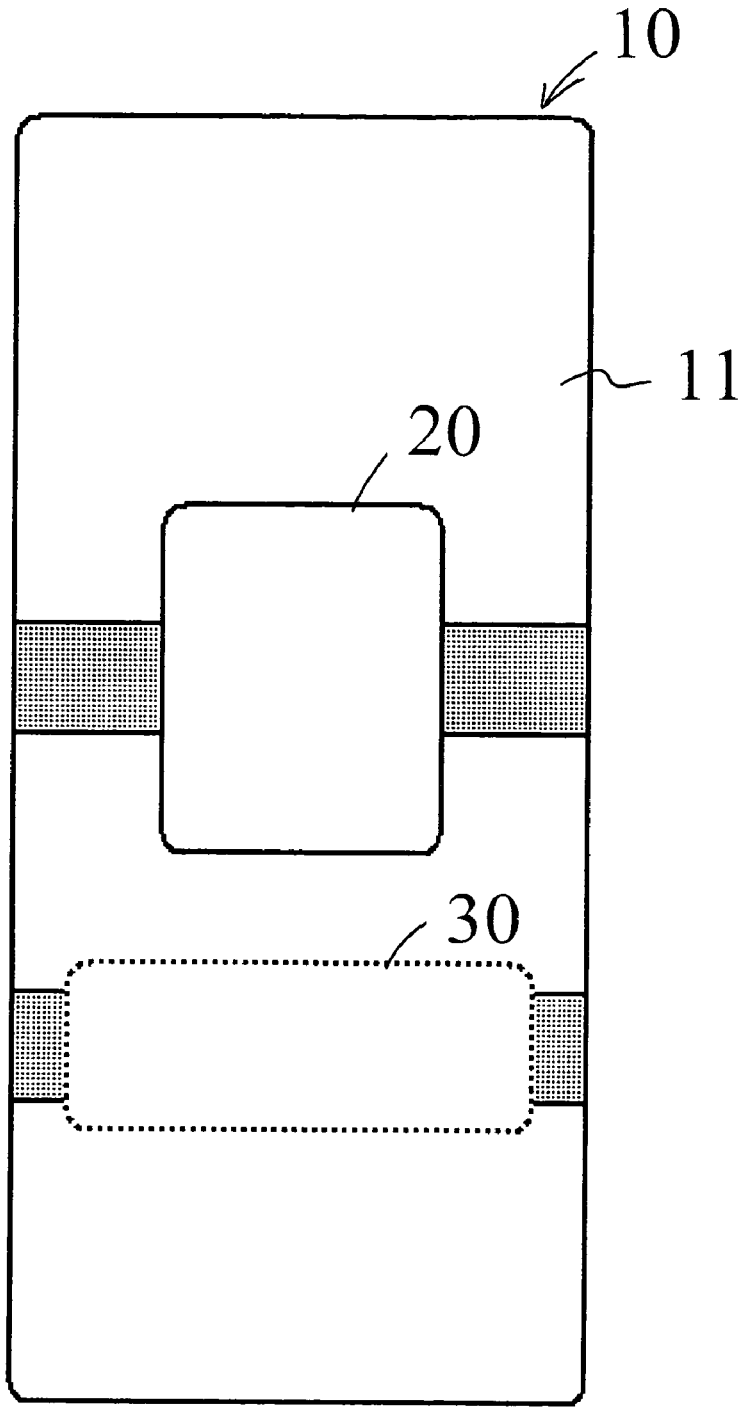
FIG. 7 is a bottom view of the mattress showing VELCRO on the bottom of the mattress.

As shown in FIG. 7, mattress 10 has a bottom surface 11 to which VELCRO material is attached adjacent tummy well 20 and adjacent breast well 30.

Mattress 10 has a bottom surface 11 to which VELCRO material is attached adjacent tummy well 20 and adjacent breast well 30.

A tummy well cloth or strip 50 is provided which is of sturdy material and which has VELCRO material attached to ends 51 and 52. The tummy well strap 50 is therefore adjustable through an infinite number of positions within the depth of tummy well 20. The user simply lies on the mattress 10 with her (or his) stomach in tummy well 20. The tummy well strap 50 is pulled taut on both ends until the proper support has been achieved and then the ends 51 and 52 are pressed against the VELCRO on the bottom surface 11 of mattress 10 and the user may sleep comfortably with proper support for her stomach and minimum pressure on her spine.

Similarly, the breast well support cloth 60 is provided having VELCRO surfaces provided at ends 61 and 62. The user simply lies on the mattress 10 with her breasts in breast well 30 and the breast well strap is pulled taut and attached to the bottom of the mattress 10 when the proper support has been achieved.

It is to be understood that the mattress design of the present invention may be used by many patients or users in addition to pregnant women. Any individuals needing to rest or sleep on their stomach may obtain the proper amount of stomach and breast support by utilizing the present invention. Persons needing only stomach support could use a mattress having only a tummy well.

Figure 1:
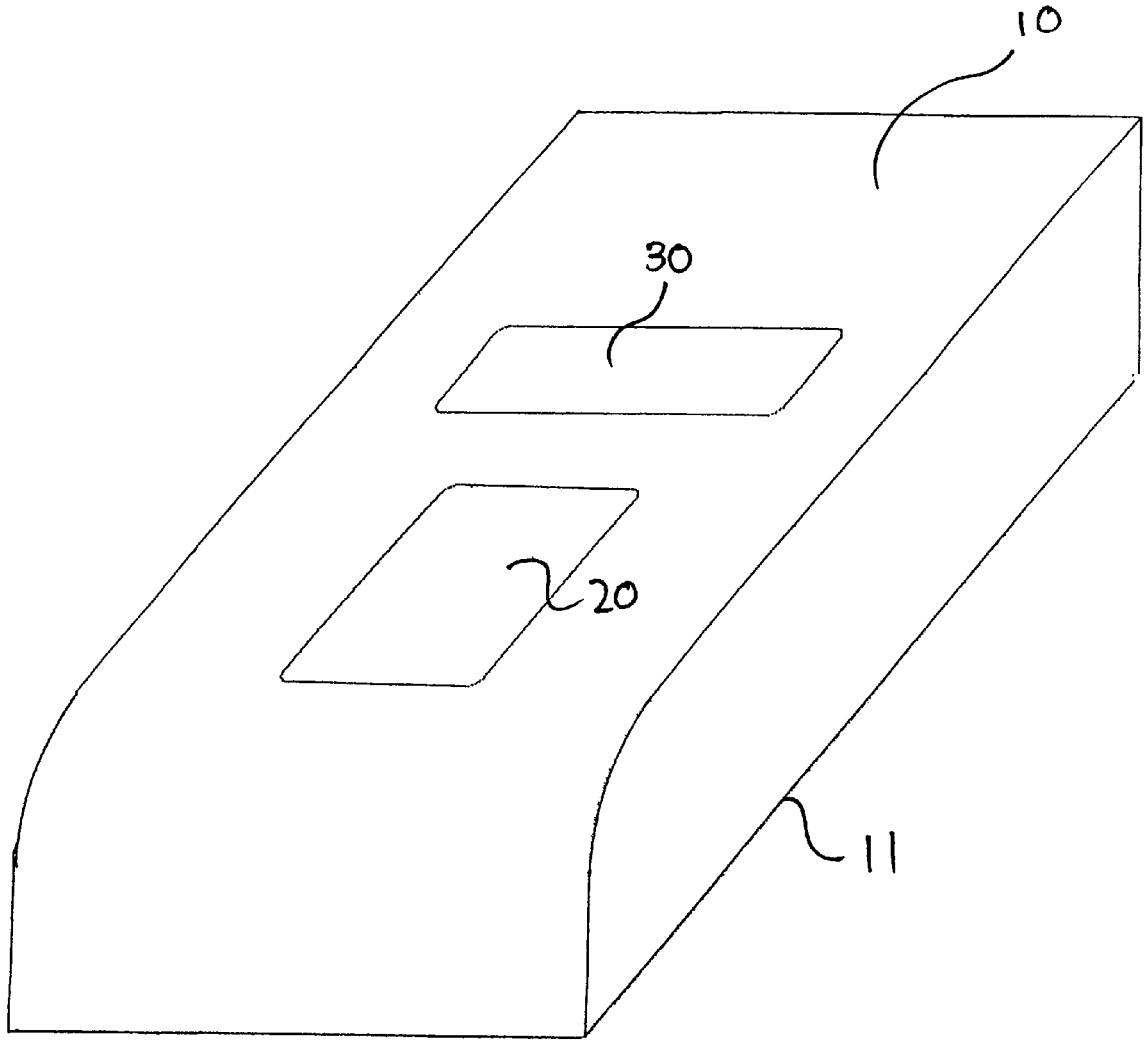
FIG. 1 is a perspective view of a mattress according to the invention.
Figure 2:
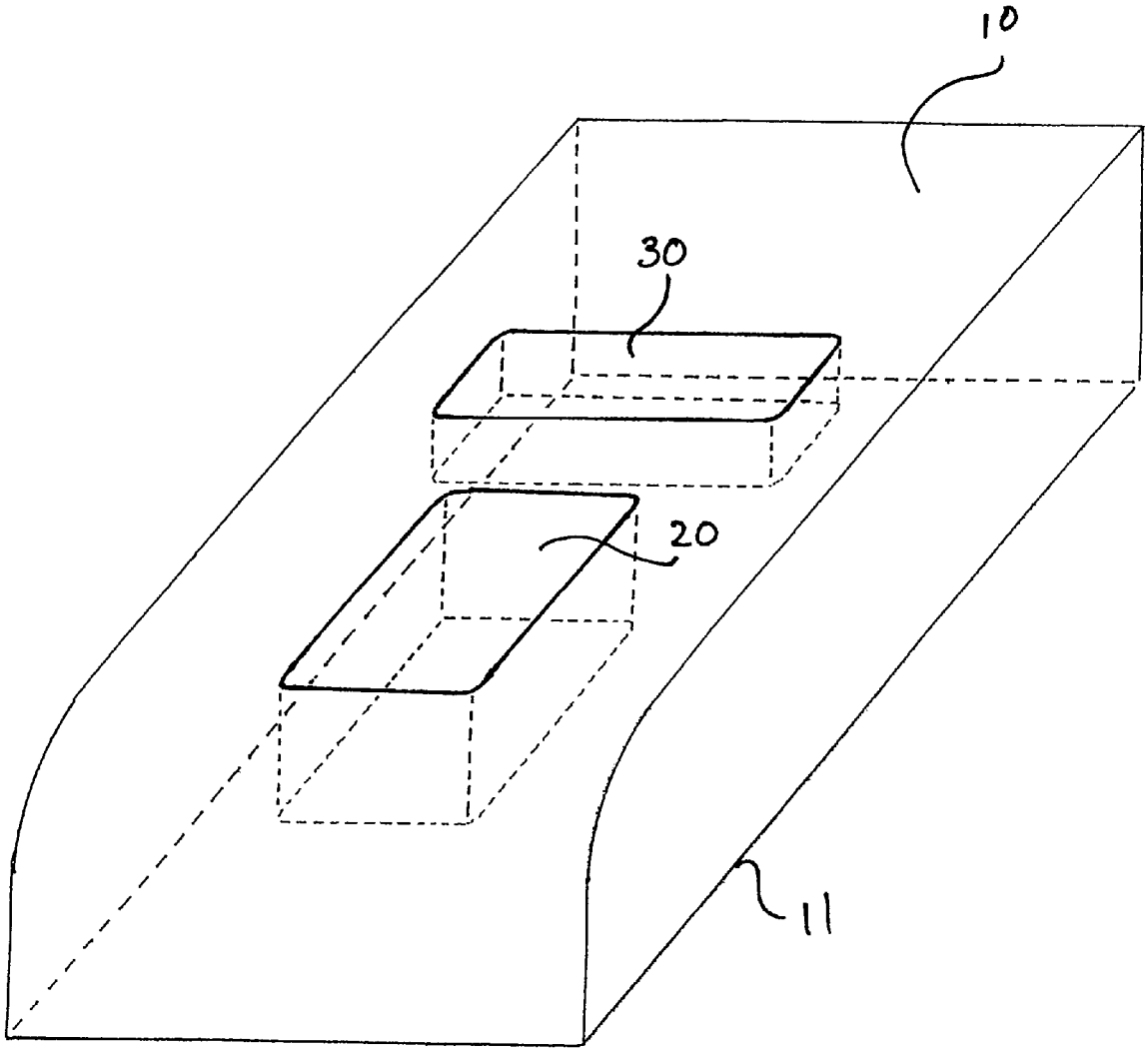
FIG. 2 is a perspective view of the mattress of FIG. 1 showing the tummy and breast wells in phantom.
Figure 3:
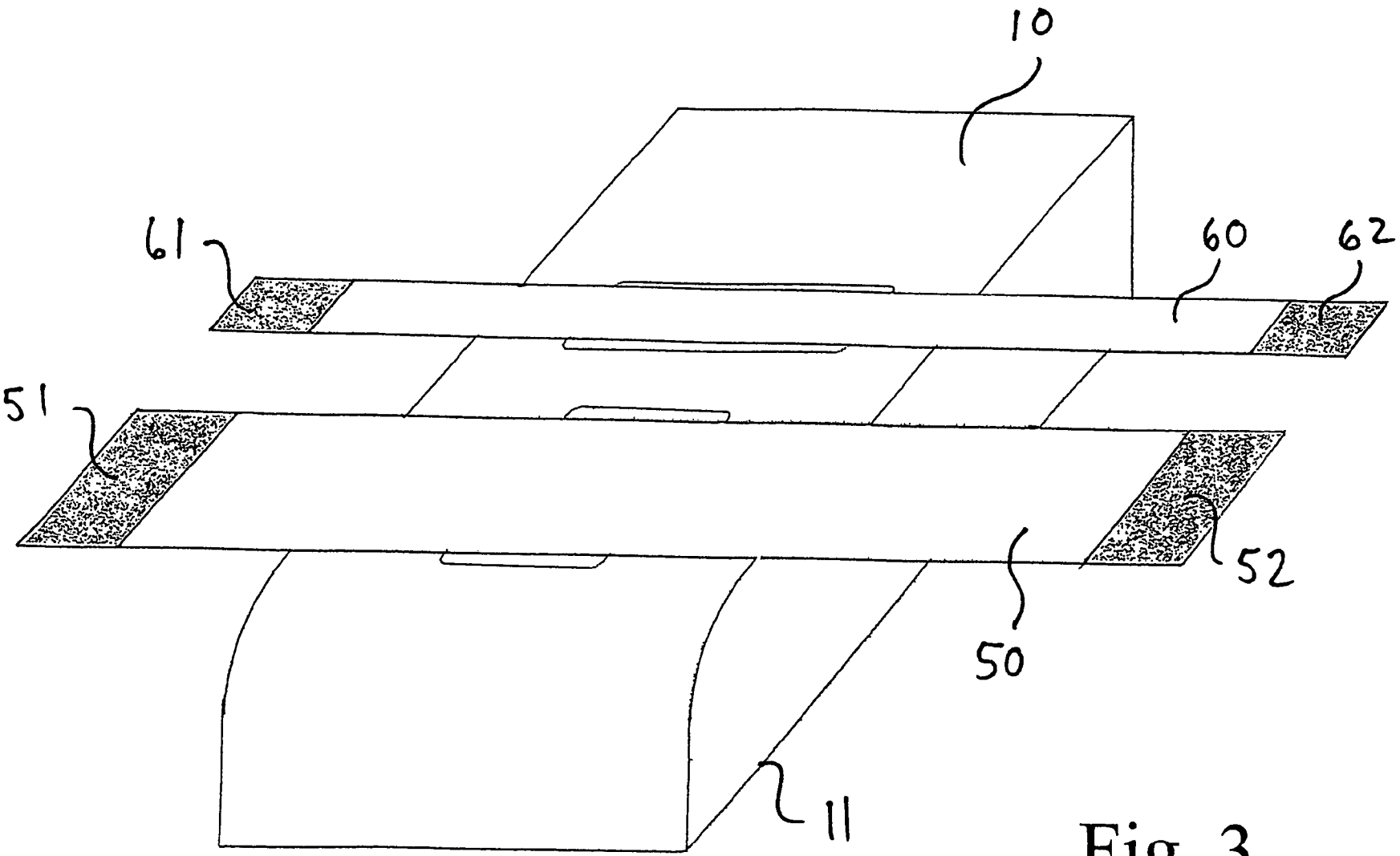
FIG. 3 shows the mattress of FIGS. 1 and 2 together with the breast well strap and tummy well strap.
Figure 4:
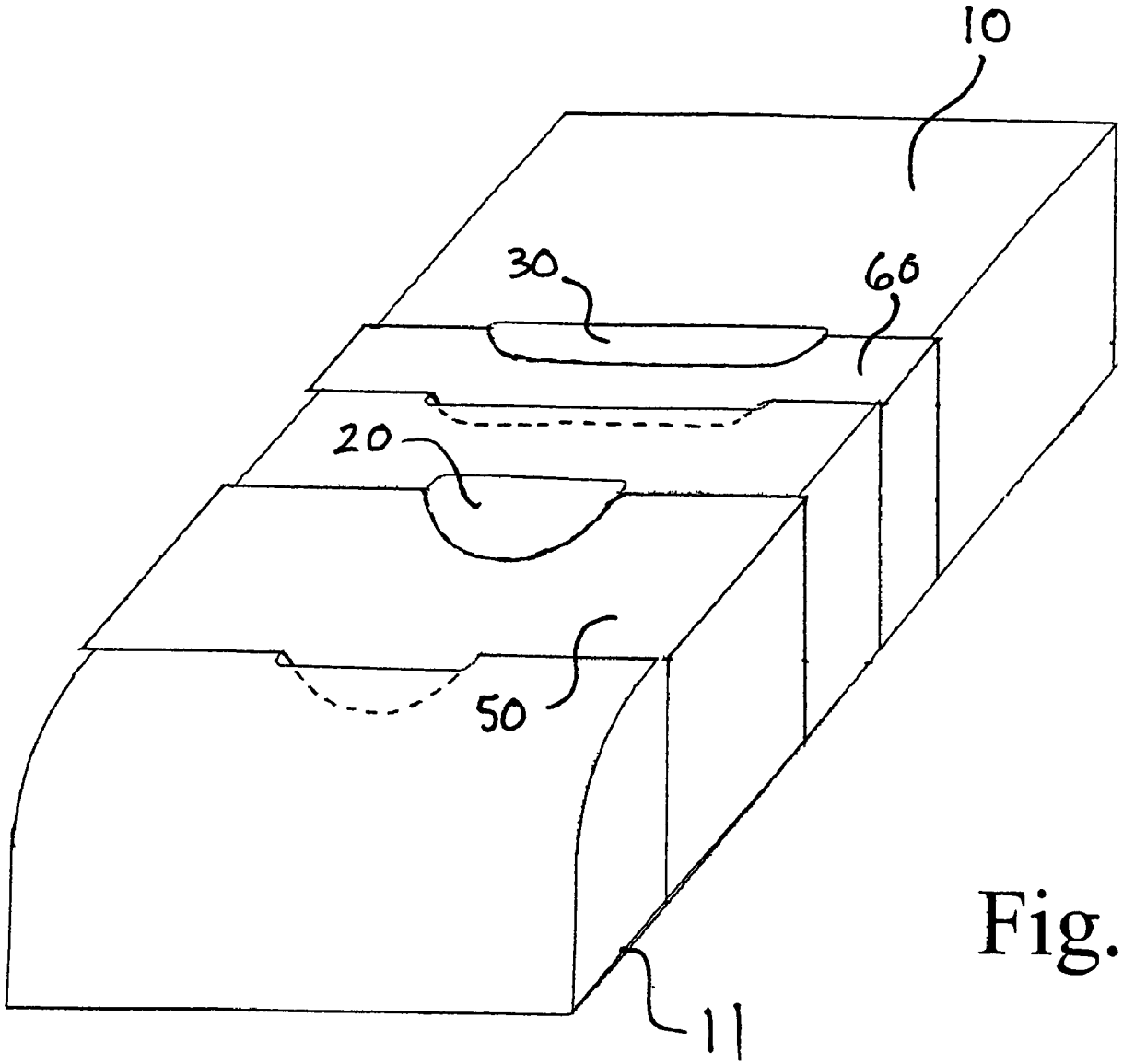
FIG. 4 shows the mattress and straps of FIG. 3 with the straps attached to the bottom of the mattress.
Figure 5:
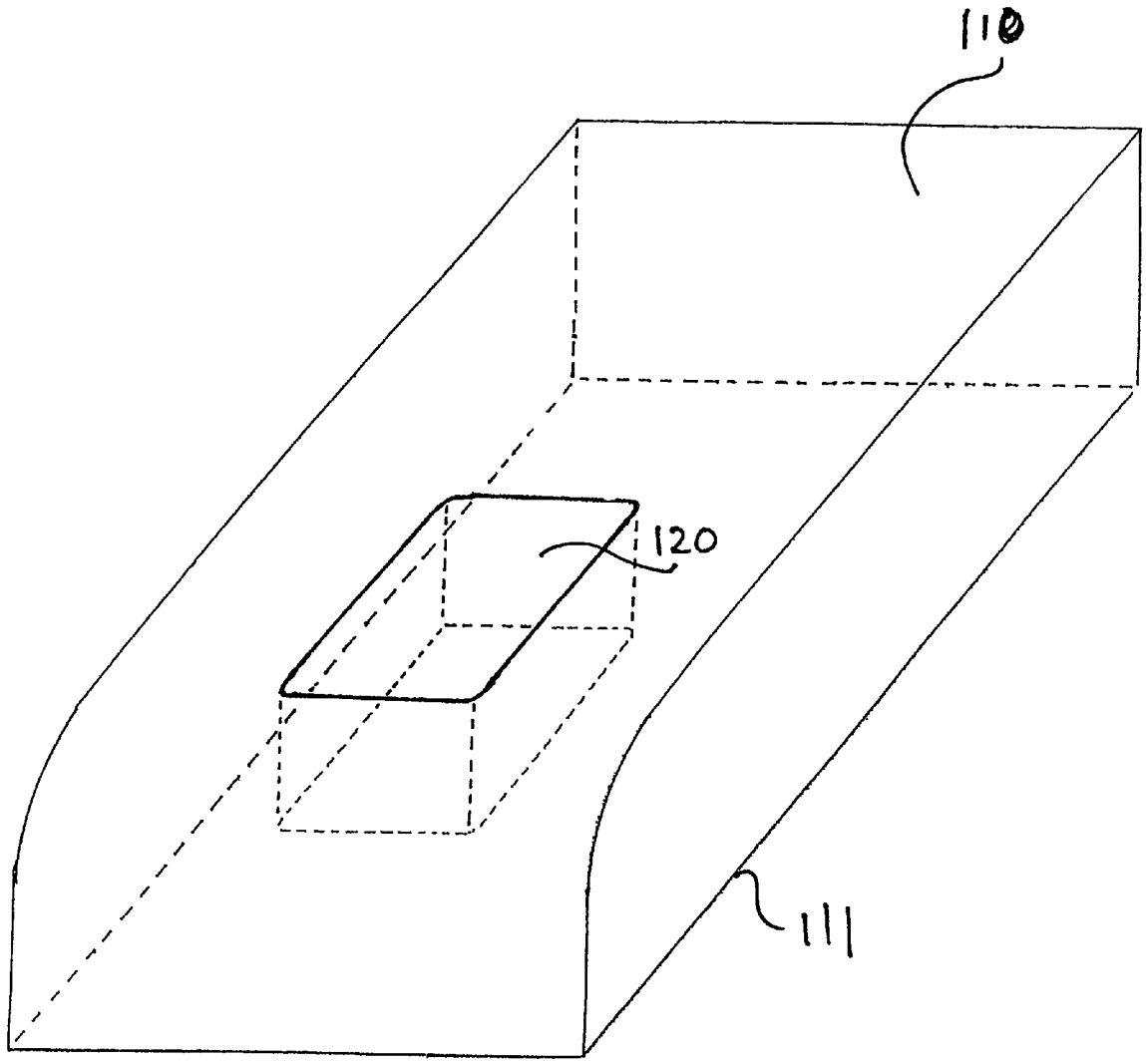
FIG. 5 shows a mattress according to the invention with only a tummy well, for use by men.
Figure 6:
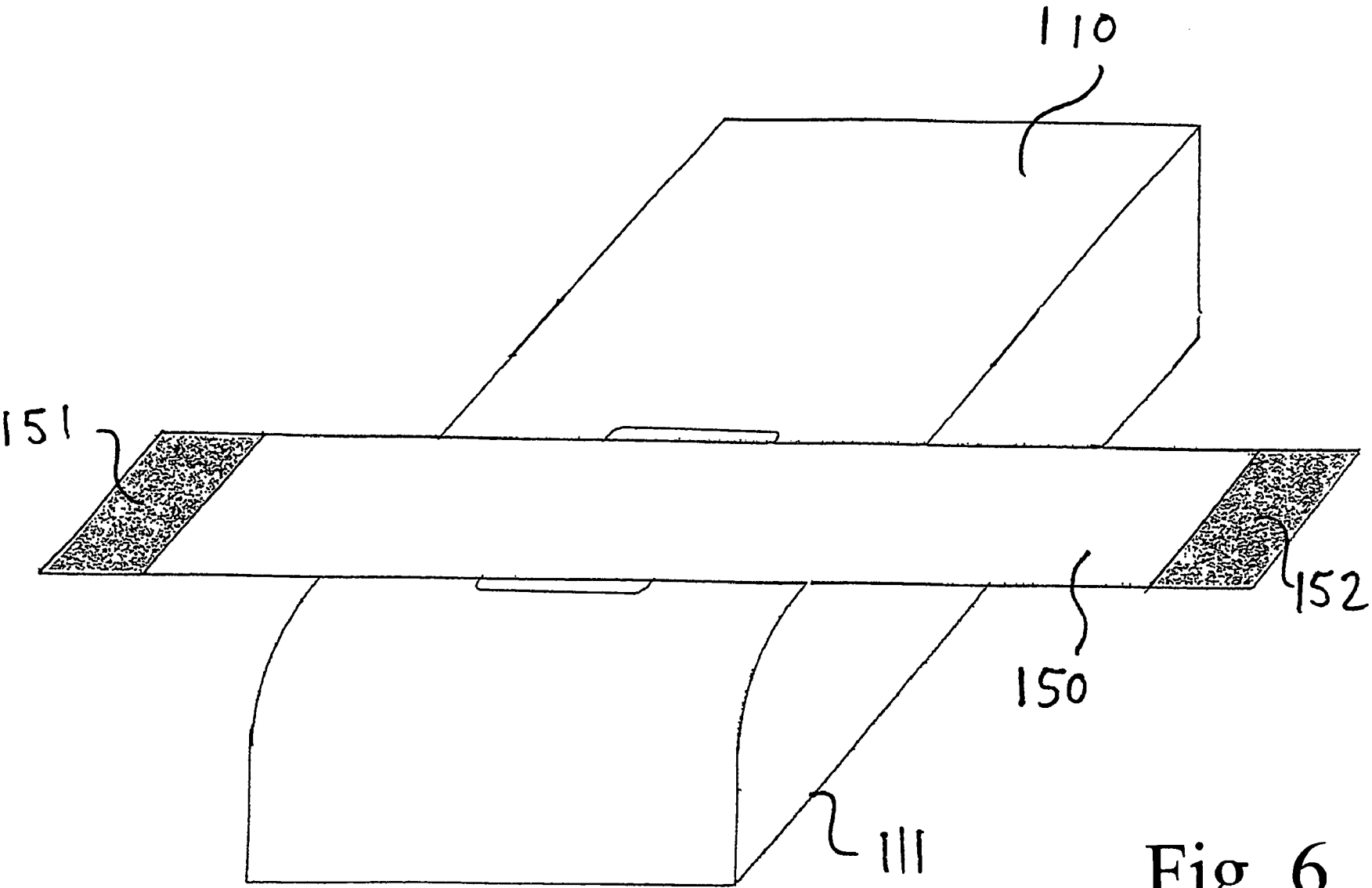
FIG. 6 shows the mattress of FIG. 5 together with the tummy well strap.

FIGS. 5 and 6 show a body bed 110 with a tummy well 120 but no breast well. Tummy well strap 150 has ends 151, 152 that carry VELCRO, which attach to VELCRO on the bottom 111 of mattress 110.

The tummy well and breast well cloths may alternately be attached to the side walls of the mattress. Although this alternate form makes it easier to apply the support cloth or strap, the support is not as secure as connecting the straps to the bottom of the mattress.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application, thereby enabling others skilled in the art to best use the invention in various embodiments and with various modifications suited to the particular use contemplated. The scope of the invention is to be defined by the following claims.

What is claimed is:

1. A body bed usable by persons to sleep on their stomachs, comprising:

a mattress, a tummy well formed in the central region of said mattress, a tummy well strap having first and second ends and hook and loop material attached to said ends, the bottom surface of said mattress carrying hook and loop material adjacent said tummy well, whereby said tummy well strap extends over said tummy well and may be continuously adjusted to a desired length within the tummy well by the user as said user is lying on said body bed.

2. The apparatus of claim 1 further comprising:

a breast well formed in said mattress, a breast well strap having first and second ends and having hook and loop material attached to said ends, and the bottom surface of said mattress carrying hook and loop material adjacent said breast well.

3. A body bed usable by pregnant women to sleep on their stomachs, comprising:

a mattress, a tummy well formed in the central region of said mattress, a tummy well strap having first and second ends and hook and loop material attached to said ends, the bottom surface of said mattress carrying hook and loop material adjacent said tummy well, a breast well formed in said mattress, a breast well strap having first and second ends and having hook and loop material attached to said ends, and the bottom surface of said mattress carrying hook and loop material adjacent said breast well, whereby said tummy well strap and said breast well strap extend over said tummy well and said breast well, respectively, and each may be separately and continuously adjusted to a desired length within said tummy well and within said breast well by the user as said user is lying on said body bed.

* * * * *